US007542844B2

(12) United States Patent
Kumagai et al.

(10) Patent No.: US 7,542,844 B2
(45) Date of Patent: Jun. 2, 2009

(54) DYNAMIC PREDICTION OF TRAFFIC CONGESTION BY TRACING FEATURE-SPACE TRAJECTORY OF SPARSE FLOATING-CAR DATA

(75) Inventors: Masatoshi Kumagai, Hitachi (JP); Tomoaki Hiruta, Hitachi (JP); Mariko Okude, Hitachi (JP); Koichiro Tanikoshi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/193,565

(22) Filed: Aug. 18, 2008

(65) Prior Publication Data

US 2009/0070025 A1 Mar. 12, 2009

(30) Foreign Application Priority Data

Sep. 11, 2007 (JP) ..... 2007-234863

(51) Int. Cl.
*G08G 1/00* (2006.01)

(52) U.S. Cl. ..... 701/117; 340/934; 340/995.13

(58) Field of Classification Search ..... 701/117–119
See application file for complete search history.

(56) References Cited

U.S. PATENT DOCUMENTS 3,239,653 A * 3/1966 Barker ..... 701/118
3,239,805 A * 3/1966 Brockett ..... 340/934
3,389,244 A * 6/1968 Brockett ..... 701/118
5,173,691 A * 12/1992 Sumner ..... 340/905
5,182,555 A * 1/1993 Sumner ..... 340/905
5,812,069 A * 9/1998 Albrecht et al. ..... 340/905
5,822,712 A * 10/1998 Olsson ..... 701/117
6,222,836 B1 * 4/2001 Sekiyama et al. ..... 370/351
6,462,697 B1 * 10/2002 Klamer et al. ..... 342/36
6,466,862 B1 * 10/2002 DeKock et al. ..... 701/117
6,574,548 B2 * 6/2003 DeKock et al. ..... 701/117
6,785,606 B2 * 8/2004 DeKock et al. ..... 701/117
6,882,930 B2 * 4/2005 Trayford et al. ..... 701/117

(Continued)

FOREIGN PATENT DOCUMENTS

JP 2004-362197 A 12/2004

(Continued)

*Primary Examiner*—Thomas G Black
*Assistant Examiner*—Shelley Chen
(74) *Attorney, Agent, or Firm*—Crowell & Moring LLP

(57) ABSTRACT

A traffic situation is predicted based on the correlation in the traffic situation between road sections. A base vector generation unit generates the base vectors constituting a feature space representing the correlation between a plurality of links by making a principal component analysis for the necessary time in the past recorded in a necessary time database. A projection point trajectory generation unit records a projection point trajectory of projecting the necessary time in the past recorded in the necessary time database to the feature space in a projection point database. A feature space projection unit projects the necessary time at present to the feature space, and a neighboring projection point retrieval unit retrieves a past projection point in the neighborhood of the concerned projection point from the projection point database, and a projection point trajectory trace unit traces the trajectory of past projection points starting from the retrieved neighboring projection point for a prediction target time width, and an inverse projection unit inversely projects the end point of the concerned trajectory to calculate the predicted value of the necessary time.

6 Claims, 10 Drawing Sheets

U.S. PATENT DOCUMENTS

| | | | | |
|---|---|---|---|---|
| 7,143,442 | B2 * | 11/2006 | Scarfe et al. | 726/23 |
| 7,167,795 | B2 * | 1/2007 | Hirose et al. | 701/210 |
| 2002/0193938 | A1 * | 12/2002 | DeKock et al. | 701/117 |
| 2003/0073406 | A1 * | 4/2003 | Benjamin et al. | 455/41 |
| 2003/0225516 | A1 * | 12/2003 | DeKock et al. | 701/214 |
| 2004/0103021 | A1 * | 5/2004 | Scarfe et al. | 705/13 |
| 2005/0222755 | A1 * | 10/2005 | Tengler et al. | 701/201 |
| 2006/0025925 | A1 * | 2/2006 | Fushiki et al. | 701/210 |
| 2006/0058940 | A1 * | 3/2006 | Kumagai et al. | 701/117 |
| 2006/0064234 | A1 * | 3/2006 | Kumagai et al. | 701/117 |
| 2006/0206256 | A1 * | 9/2006 | Kumagai et al. | 701/117 |
| 2006/0242610 | A1 * | 10/2006 | Aggarwal | 716/1 |
| 2007/0208493 | A1 * | 9/2007 | Downs et al. | 701/117 |
| 2007/0208494 | A1 * | 9/2007 | Chapman et al. | 701/117 |
| 2007/0208495 | A1 * | 9/2007 | Chapman et al. | 701/117 |
| 2007/0208496 | A1 * | 9/2007 | Downs et al. | 701/117 |
| 2007/0208501 | A1 * | 9/2007 | Downs et al. | 701/119 |
| 2008/0030371 | A1 * | 2/2008 | Kumagai et al. | 340/905 |
| 2008/0046165 | A1 * | 2/2008 | Downs et al. | 701/117 |
| 2008/0059051 | A1 | 3/2008 | Kumagai et al. | |
| 2008/0071465 | A1 * | 3/2008 | Chapman et al. | 701/117 |
| 2008/0114529 | A1 * | 5/2008 | Hiruta et al. | 701/117 |

FOREIGN PATENT DOCUMENTS

| | | | |
|---|---|---|---|
| JP | 2006-79483 | A | 3/2006 |
| JP | 2006-251941 | A | 9/2006 |

* cited by examiner

FIG. 3

(a)

Necessary time table (in the case of probe data only)

| | Link 1 | Link 2 | Link 3 | ... | Link M |
|---|---|---|---|---|---|
| 07/03/01 00:00, t_1 | 320 | — | 150 | | 1000 |
| 07/03/01 00:05, t_2 | 300 | 520 | — | | — |
| 07/03/01 00:10, t_3 | — | 500 | — | | — |
| ⋮ | ⋮ | ⋮ | ⋮ | ⋮ | ⋮ |
| 07/03/31 23:55, t_N | 350 | — | — | | 800 |

– is unknown value.

(b)

Necessary time table (in the case of using both probe data and road sensor data)

| | Link 1 | | ... | Link M | |
|---|---|---|---|---|---|
| | Probe | Road sensor | | Probe | Road sensor |
| 07/03/01 00:00, t_1 | 320 | — | ... | 1000 | 900 |
| 07/03/01 00:05, t_2 | 300 | 290 | ... | — | — |
| 07/03/01 00:10, t_3 | — | 300 | ... | — | 950 |
| ⋮ | ⋮ | ⋮ | ⋮ | ⋮ | ⋮ |
| 07/03/31 23:55, t_N | 350 | 320 | ... | 800 | 910 |

– is unknown value.

FIG. 4

Projection point table

| | Base 1 | Base 2 | Base 3 | ... | Base P |
|---|---|---|---|---|---|
| 07/03/01 00:00, t_1 | 1.5 | 2.3 | 0.5 | | 3.8 |
| 07/03/01 00:05, t_2 | 1.7 | 2.1 | 0.9 | | 3.2 |
| 07/03/01 00:10, t_3 | 2.2 | 1.8 | 0.7 | | 3.5 |
| ⋮ | | | | | |
| 07/03/31 23:55, t_N | 2.5 | 2.0 | 0.8 | | 3.0 |

DYNAMIC PREDICTION OF TRAFFIC CONGESTION BY TRACING FEATURE-SPACE TRAJECTORY OF SPARSE FLOATING-CAR DATA

BACKGROUND OF THE INVENTION

1. Field of the Invention

The present invention relates to a traffic situation prediction apparatus and a traffic situation prediction method for predicting a change in the traffic situation in the future from the traffic situation in the past.

2. Background Art

Conventionally, a probe car is often used to predict a traffic situation on the road. The probe car is the vehicle that mounts the in-car equipment comprising various sensors and a communication apparatus to collect data such as vehicle position and traveling speed from various sensors, and transmit the collected data (hereinafter probe car data) to a predetermined traffic information center. The probe car is often a taxi in cooperation with a taxi company, or a private car under the contract with the user as a part of traffic information services intended for the private car, for example.

JP Patent Publication (Kokai) No. 2004-362197 disclosed the invention for predicting a change in the traffic situation by measuring a change pattern of the necessary time at present with the road sensor or probe car and retrieving the analogous change pattern from the history of the necessary time in the past.

SUMMARY OF THE INVENTION

The invention of JP Patent Publication (Kokai) No. 2004-362197 is aimed to predict the traffic situation in the section where the road sensor is installed or the probe car runs. However, the probe car is not always running in all the road sections. Hence, in the road section in which the probe car is not running, and the necessary time at present is not measured, the traffic situation can not be predicted.

Thus, it is an object of the invention to predict the traffic situation even in the road section in which the probe car is not running at present, based on the necessary time at present measured in the peripheral road section and the correlation in the necessary time between the concerned road section and the peripheral road section.

A traffic situation prediction apparatus of the invention comprises a necessary time database for recording, for a plurality of links, the necessary time for each link (road section between main intersections) measured by a probe car and a road sensor, a base vector generation unit for generating the base vectors representing the correlation in the necessary time between the concerned links by making a principal component analysis for the necessary time of the plurality of links recorded in the past, a feature space projection unit for projecting the necessary time of the plurality of links at present to a feature space constituted of the base vectors generated by the base vector generation unit to obtain a projection point, a neighboring projection point retrieval unit for retrieving a projection point in the neighborhood of the projection point representing the traffic situation of the plurality of links from among the projection points projected in the past inside the feature space, a projection point trajectory trace unit for tracing the projection point trajectory that is a sequence of projection points projected in the past arranged in order starting from the retrieved projection point for a prediction target time width (time width corresponding to a difference between the present time and the prediction target time), and an inverse projection unit for making the inverse projection operation that is a linear combination of the base vectors, of which the coefficients are the coordinates of the predicted projection point at the end point of the traced trajectory, and outputting the traffic situation vector resulting from the operation as the predicted value of the necessary time of the plurality of links.

With the invention, even when there is any link for which the present traffic situation is unknown, the necessary time in the future can be predicted for the link for which the necessary time at present is not measured by calculating the predicted projection point based on the projection point trajectory in the past and inversely projecting it in the feature space.

BRIEF DESCRIPTION OF THE DRAWINGS

FIG. 3 is a view showing the data structure of a necessary time table.

FIG. 4 is a view showing the data structure of a projection point table.

DESCRIPTION OF REFERENCE NUMERALS

Figure 1:
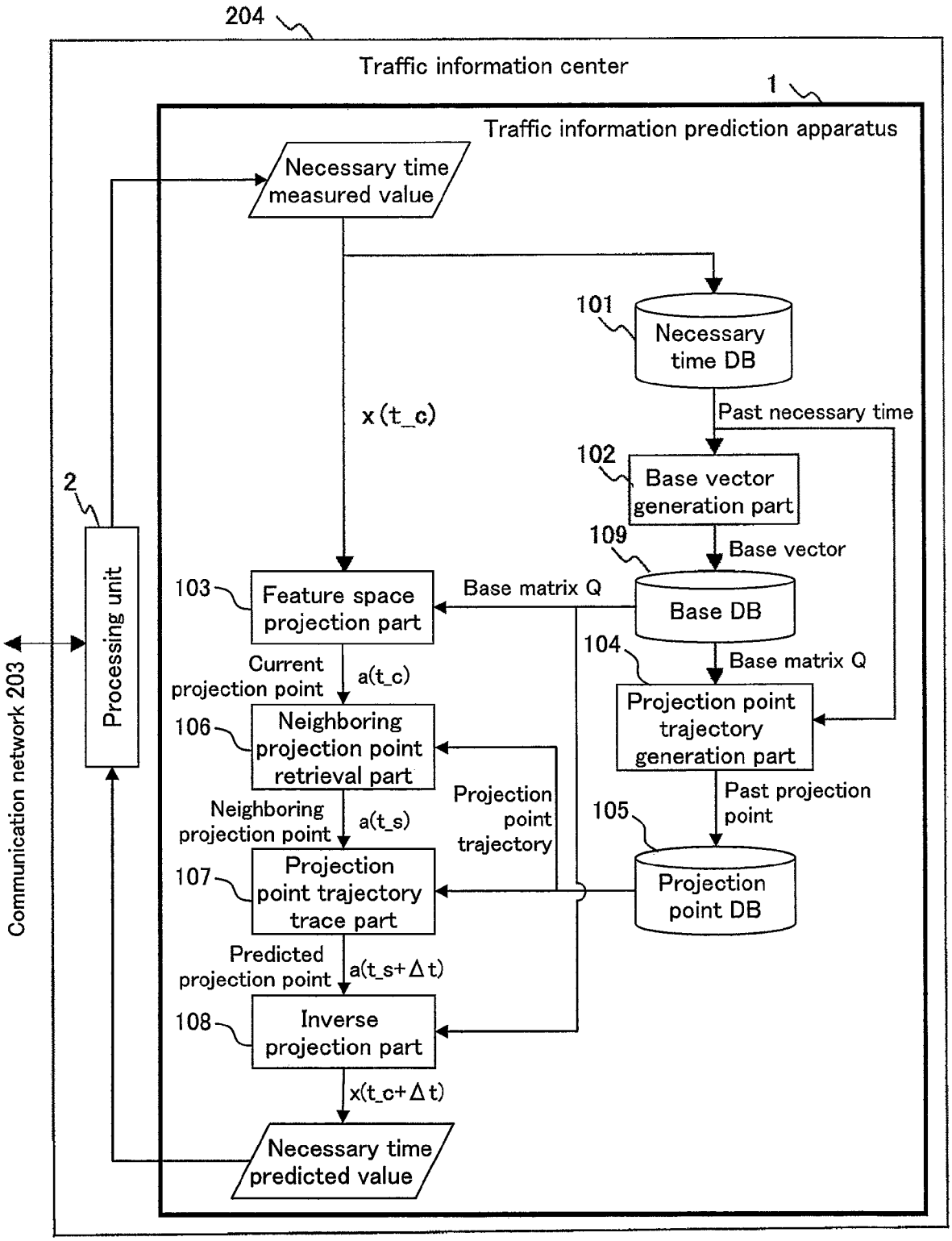
FIG. 1 is a block diagram of a traffic situation prediction apparatus according to an embodiment of the present invention.

1 traffic information prediction apparatus
2 processing unit
101 necessary time DB
102 base vector generation unit
103 feature space projection unit
104 projection point trajectory generation unit
105 projection point DB
106, 801 neighboring projection point retrieval unit
107, 802 projection point trajectory trace unit
108 inverse projection unit
109 base DB
803 gravitational center operation unit

DETAILED DESCRIPTION OF THE PREFERRED EMBODIMENTS

The embodiments of the present invention will be described below in detail with reference to the drawings.

Embodiment 1

Figure 2:
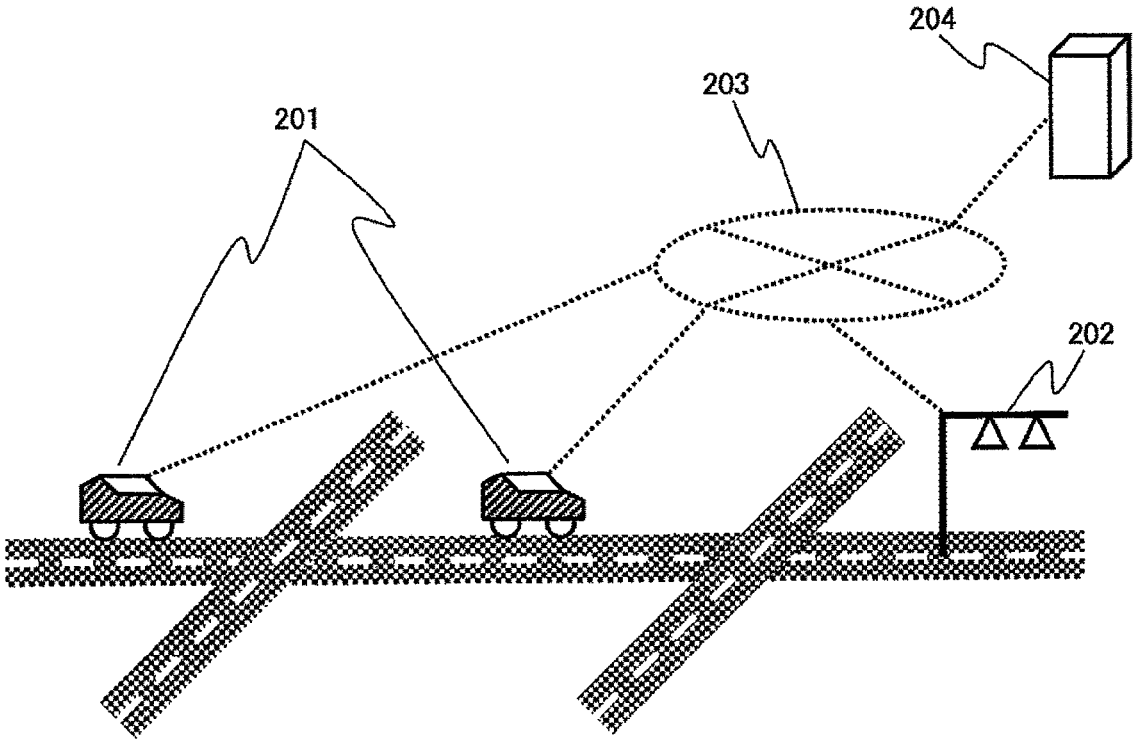
FIG. 2 is a view showing a collection path of traffic information inputted into the traffic situation prediction apparatus according to the embodiment of the invention.

FIG. 1 is a diagram showing an example of the configuration of a traffic information prediction apparatus according to an embodiment of the invention. A necessary time database (hereinafter, a necessary time DB) 101 is a storage unit that records the necessary time for each link inputted into the traffic information prediction apparatus 1. Herein, the link means a road section as the unit in processing the traffic information, such as a road section between main intersections. As regards the necessary time for each link, data (probe car data) collected by a probe car 201 on a road network and road sensor data measured by a road sensor 202 are transmitted to a traffic information center 204 having the traffic information prediction apparatus 1 across a communication network 203, as shown in FIG. 2.

In the traffic information center 204, the received data is converted into the necessary time on the concerned link by a processing unit 2, and inputted into the traffic information prediction apparatus 1. At this time, if the received data is probe car data, the link where the car is running is specified and the necessary time for transit between places corresponding to the positional information is calculated from the data collection time and positional information included in the received data, based on map information, not shown, and the necessary time for the concerned link is obtained. Also, if the received data is road sensor data, the link on which the road sensor is installed is specified from a sensor ID included in the received data, and the necessary time for the concerned link is obtained. And data received for a predetermined accumulation time interval is accumulated, and inputted into the traffic information prediction apparatus 1 as a necessary time measured value at a certain time. The necessary time measured value at the certain time inputted into the traffic information prediction apparatus 1 is accumulated successively in the necessary time DB 101, and inputted as present traffic information into a feature space projection unit 103.

The necessary time DB 101 comprises a necessary time table including the time of collecting data and a link number for identifying the link as an index, as shown in FIG. 3. A unit of creating the necessary time table, namely, a link set (hereinafter a prediction target link set) of processing unit in a process for predicting traffic information as will be described later, is the links included in one mesh (grid area as large as about 10 km×10 km) on the map, for example. Herein, it is assumed that the number of links included in the prediction target link set is M.

FIG. 3A is a necessary time table generated using probe car data, which stores as the necessary time for each link the value of averaging or integrating the necessary time obtained from probe car data collected from plural probe cars on a link basis. Also, FIG. 3B is a necessary time table generated using probe car data and road sensor data, in which the necessary time for each link is administered including the necessary time from the probe car data as in FIG. 3A and the necessary time from the road sensor data as different data. The necessary time with the probe car data at the time when the probe car is not running on the concerned link is stored as data indicating the unknown value, because the necessary time can not be acquired. Also, the necessary time with the road sensor data for the link where no road sensor is installed is stored as data indicating the unknown value.

Each row of the necessary time table is a traffic situation vector including a factor of the necessary time for each time index in the prediction target link set. It is assumed that the number of rows in the necessary time table, or the number of time indexes recording the necessary time is N. The necessary time table accumulates data for about one week to one year. When the invention is used, a traffic situation vector for about one week may be accumulated if the ordinary traffic event is predicted. However, to cope with the consecutive holidays or singular days in the calendar that appear depending on the season, data for one year may be needed, because data applicable to such an event is needed. To predict the ordinary traffic event precisely, the data accumulation period may be about one month, or four weeks (28 days), in which if the accumulation time interval is 5 minutes, the number of data per day is 288, and the number N of time indexes recording the necessary time is 288×28=8064.

The necessary time recorded in the necessary time table is not always the necessary time instantaneous at the time index. For example, in the case of taking the time index at every 5 minute interval, it is allowable that the necessary time measured for 5 minutes in a period of the time index, or its average value, is the necessary time of the concerned time index.

A base vector generation unit 102 generates the base vector that is a principal axis vector in the feature space as the component changing with correlation by making a principal component analysis for the necessary time table recorded in the necessary time DB 101 to decompose data of plural links into the component changing with correlation and the component changing without correlation. This base vector is a reference pattern representing the correlation between links, and the original necessary time data can be represented by a representative variable corresponding to each base vector that is the principal axis vector in the feature space. And as the property of the feature space obtained through the principal component analysis, the traffic situation vector (vector having a factor of the necessary time of each link) at any time for plural links of processing object is projected into one point in the feature space. By inversely projecting the concerned projection point, a vector approximating the original traffic situation vector is obtained. That is, the projection point in the feature space corresponds to the actual traffic situation vector at a certain time.

Even if the necessary time table contains the unknown value, the base vector can be generated by a "principal component analysis with missing data (PCAMD)" that is an extended method of the principal component analysis. Herein, providing that the number of base vectors is P, $P \ll M$ from the property of the principal component analysis. The generated P base vectors are stored in a base database (hereinafter a base DB) 109. Herein, P is decided by selecting the bases in decreasing order of the contribution ratio obtained for each base by the principal component analysis and using a cumulative contribution ratio of adding the contribution ratios corresponding to the selected bases as the index. The cumulative contribution ratio is higher as the number P of base vectors is increased, and takes the value between 0 and 1, whereby the value of P is decided so that the cumulative contribution ratio may be 0.8 or more, for example. Such base vectors have the property of approximating any traffic situation vector included in the necessary time table subjected to the principal component analysis by the linear combination with the corresponding representative variables as the coefficients.

Also, even with the traffic situation vector at the time not included in the necessary time table, as the property of the feature space obtained by the principal component analysis, the traffic situation vector at any time in the prediction target link set is projected into one point in the feature space spanned by the base vectors. The point in this feature space is the projection point having the value of representative variable corresponding to each base vector by projection as the coordinate value. And if this projection point is inversely projected, the vector approximating the traffic situation vector at the time not included in the original necessary time table is obtained. That is, the projection point in the feature space corresponds to the actual traffic situation vector at the certain time.

Describing the base vector associated with an actual traffic phenomenon, the base vector is a traffic congestion pattern, numerically representing the correlation in the traffic situation between plural links changed spatially. Though the traffic congestion pattern depends on the structure of a road network, for example, if the principal component analysis is performed for the links included in an area 20 kilometers square in central Tokyo, the base vectors corresponding to a plurality of traffic phenomena, such as a traffic congestion downtown, traffic congestion in belt line, a traffic congestion in the direction flowing into the central unit, and a traffic congestion in the direction flowing out of the central unit, are obtained. The plurality of base vectors at the higher level correspond to more common patterns as actually seen.

The base vector and the projection point trajectory generated by the base vector generation unit 102 and a projection point trajectory generation unit 104 do not need to be calculated every time of generating the traffic information, but may be calculated in advance. In this case, the base vector and the projection point trajectory may be updated at a frequency of once per week to year, corresponding to the data accumulation period in the necessary time table as previously described. Besides periodical update, the base vector and the projection point trajectory may be updated, with the new construction of a road as the trigger, for the map mesh where the road is newly constructed, after the passage of the data accumulation period in the necessary time table.

The feature space projection unit 103 projects the traffic situation vector at the present time t_c in the prediction target link set inputted into the traffic situation prediction apparatus to the feature space spanned by the base vectors 1 to P generated by the base vector generation unit 102. If the traffic situation vector contains the unknown value, namely, the link for which the necessary time is unknown exists in a unit of plural links, the weighted projection is performed in accordance with the following expression.

$$a(t_c)=inv(Q'W'WQ)Q'W'Wx(t_c)' \quad \text{(Formula 1)}$$

Where Q is a base matrix in which the base vectors 1 to P are arranged. Also, x(t_c) is the present traffic situation vector. W is a weighting matrix, in which if the necessary time for link i is obtained as the observed value, the ith diagonal element is 1, or if the necessary time for link i is unknown value, the ith diagonal element is 0, and other non-diagonal elements are 0. Thereby, as the weight of observation data is 1 and the weight of missing data is 0, the projection point a(t_c) is obtained to minimize an error from data before projection, when projecting it to the feature space for the link for which the present data is observed by ignoring the link of missing data. The weighting matrix W is changed depending on the situation of collecting probe car data or road sensor data at each time, and calculated by the feature space projection unit 103, every time of predicting the necessary time.

Figure 10:
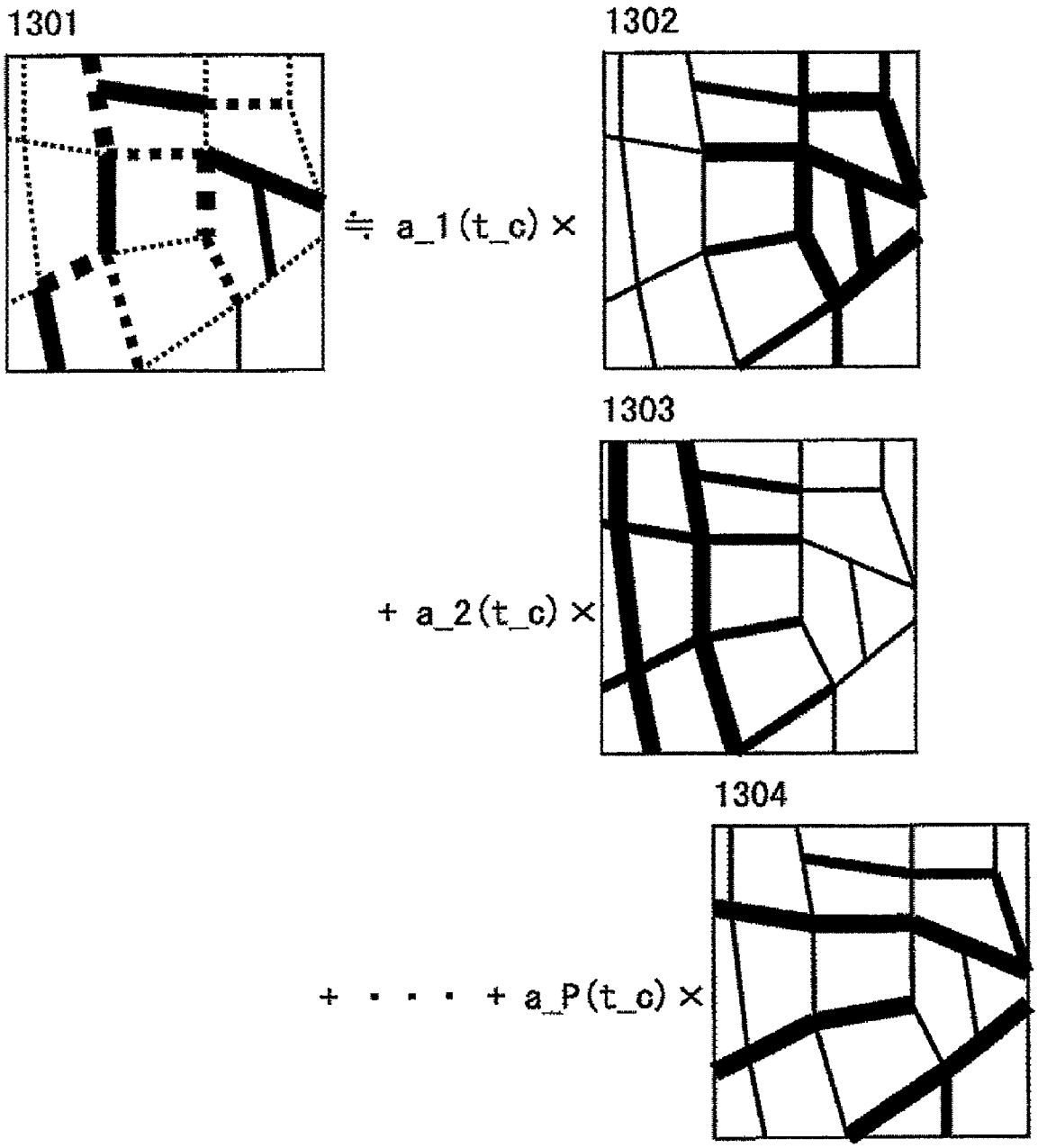
FIG. 10 is a view for explaining the relationship between the bases and the projection points in the necessary time data at present.

FIG. 10 is a typical view of a road network showing the specific action of this arithmetic operation. The heavy line segment denotes the link in congestion and the fine line segment denotes the empty link. The base vector represents the congestion pattern, as described above. In FIG. 10, reference numerals 1302, 1303 and 1304 correspond to the base vectors. On the other hand, reference numeral 1301 denotes a traffic situation vector corresponding to the actual traffic situation at time t_c, in which the link of the solid line is the link for which the necessary time is observed, and the link of the dotted line is the link for which the necessary time is unknown. In the arithmetical operation of formula 1, there is an operation of calculating the coefficients a_1(t_c), a_2(t_c), . . . , and $a_P$(t_c) in the linear combination of the base vectors (1302, 1303, 1304), based on the observed value of the necessary time as indicated by the solid line. In FIG. 10, the vector a(t_c) having the factors of coefficients a_1(t_c), a_2(t_c), . . . , and $a_P$(t_c) in representing the traffic situation vector (1301) at time t_c with the linear combination of the base vectors (1302, 103, 1304) is the coordinate vector of the projection point in the feature space, in which each element of a(t_c) is the coordinate value on the coordinate axis along the base vector 1 to P.

The projection point trajectory generation unit 104, like the feature space projection unit 103, obtains the projection points by projecting the traffic situation vector accumulated in the necessary time table to the feature space, based on the base vectors stored in the base DB 109 through the arithmetical operation process with the formula 1. However, the arithmetical operation object of the feature space projection unit 103 is the traffic situation vector at the present time, whereas the projection point trajectory generation unit 104 projects the traffic situation vector that is information of the past necessary time included in the necessary time table of the necessary time DB 101 to generate the past projection points a(t_1) to a(t_N) corresponding to the time indexes t_1 to t_N, and record them in the projection point DB 105 in time sequence. The projection points recorded in time sequence are the projection point trajectory. The data structure of the projection point DB 105 is the table including the time t_1 to t_N corresponding to the necessary time table and the base vectors 1 to P as the indexes, with the values of the coefficients corresponding to the base vectors, in which the value of the base vector i at time t_m is the coefficient a_i(t_m) corresponding to the base vector i of the projection point a(t_m), as shown in FIG. 4. This table is the projection point table.

Figure 5:
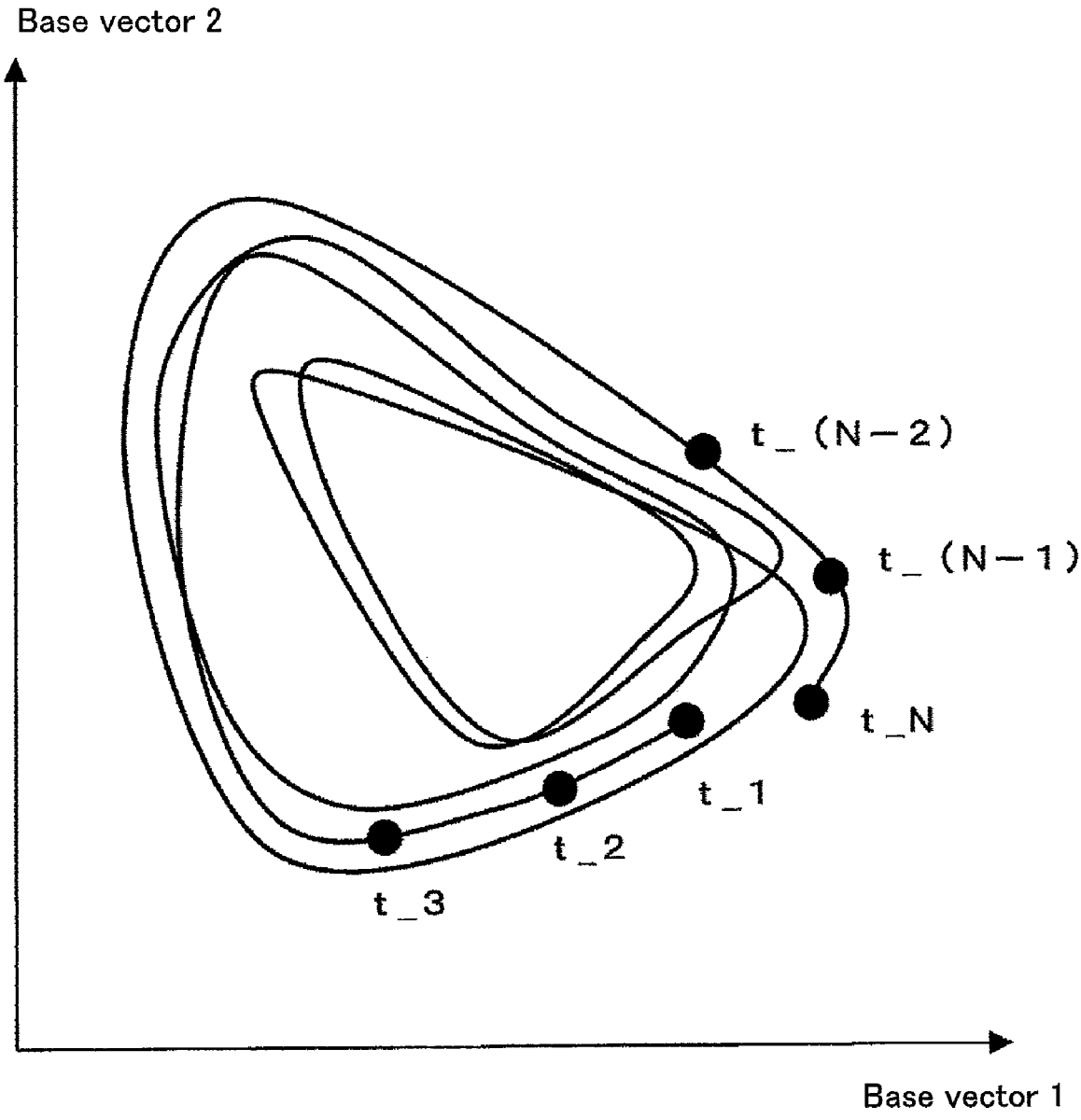
FIG. 5 is a view showing the time varying trajectory of projection point in the past.

If the projection points generated by the projection point trajectory generation unit 104 are illustrated on the plane with the base vector 1 and the base vector 2 as the coordinate axes, the trajectory is drawn as shown in FIG. 5. The coordinate plane of FIG. 5 is a two dimensional partial space spanned by the base vectors 1 and 2 in the feature space with the base vectors. The projection points a(t_1) to a(t_N) draw the continuous trajectory with the passage of time. Likewise, in the two dimensional partial space spanned by the base vectors 3 and 4, the projection points a(t_1) to a(t_N) also draw the continuous trajectory with the passage of time. These trajectories of projection points change periodically, because the traffic phenomenon has periodicity of day or week.

Figure 6:
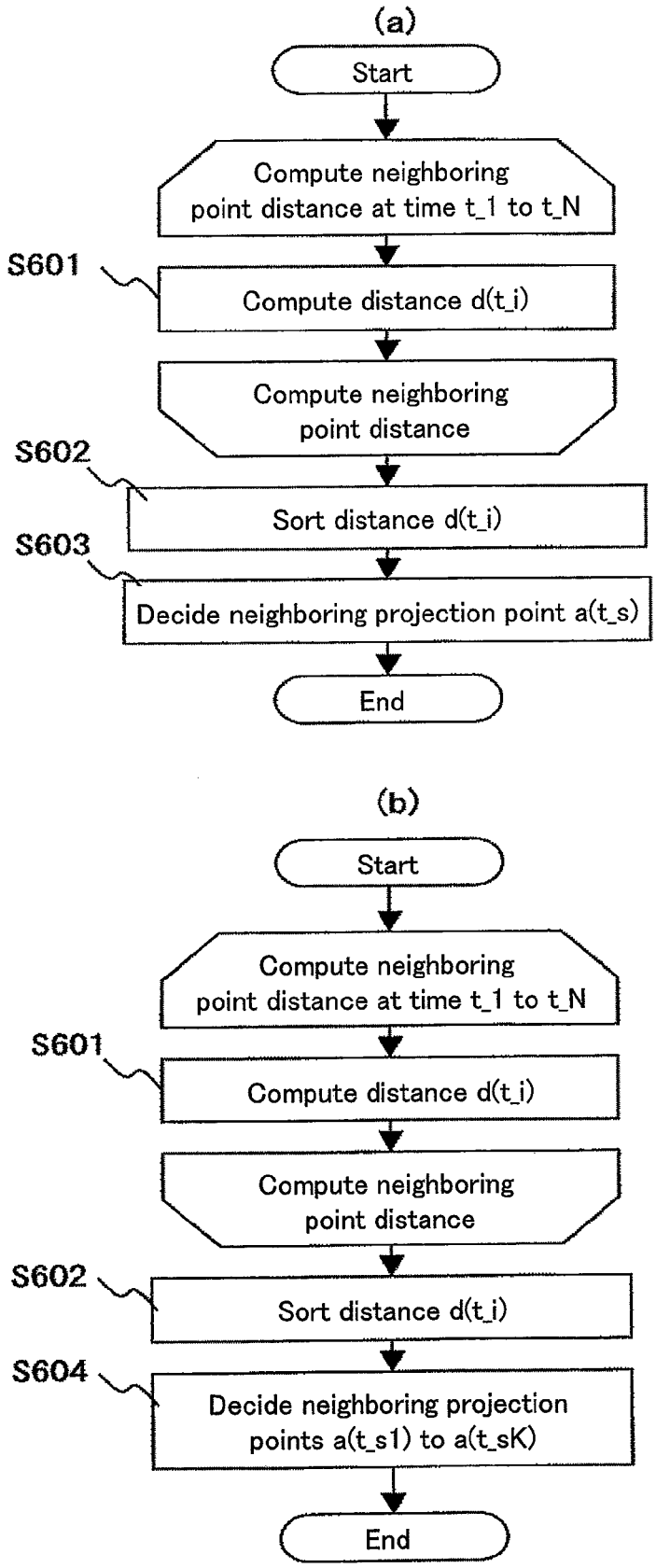
FIG. 6 is a flowchart of processing flow in a neighboring projection point retrieval unit.

The neighboring projection point retrieval unit 106 retrieves the projection point having the shortest distance from the projection point a(t_c) at the current time t_c from the projection points a(t_1) to a(t_N) recorded in the projection point DB 105. A process of the neighboring projection point retrieval unit 106 is represented in the processing flow, as shown in FIG. 6A. First of all, a loop process is repeated from time t_1 to t_N, and at step S601 within this loop, the distance d(t_i) between the projection point a(t_c) obtained from the traffic situation vector at the current time t_c by the feature space projection unit 103 and the projection point a(t_i) at the past time t_i read from the projection point DB 105 is computed. The distance d(t_i) is the Euclid norm of a difference vector between a(t_i) and a(t_c). The shorter distance in the feature space indicates that the traffic situation vectors corresponding to both the projection points are analogous. After this process, the distances d(t_1) to d(t_N) are sorted at step S602, and the time corresponding to the past projection point in which the distance d is shortest among the sorted distances is set to the neighboring projection point time t_s and the past projection point is set to the neighboring projection point a(t_s) at step S603.

Predicting the traffic situation at the future time t_c+Δt for the current time t_c can be made by predicting the projection point a(t_c+Δt) in the base matrix Q at the future time t_c+Δt, because the projection point in the feature space corresponds to the actual traffic situation. In this case, since the projection point trajectory has periodicity as shown in FIG. 5, the projection point a(t_c) at the current time t_c tends to follow the analogous trajectory to the neighboring projection point a(t_s). Therefore, when the traffic situation at the future time t_c+Δt is predicted for the current time t_c, the future traffic situation can be expected to change along the projection point trajectory starting from the neighboring projection point a(t_s) of the projection point a(t_c).

Figure 7:
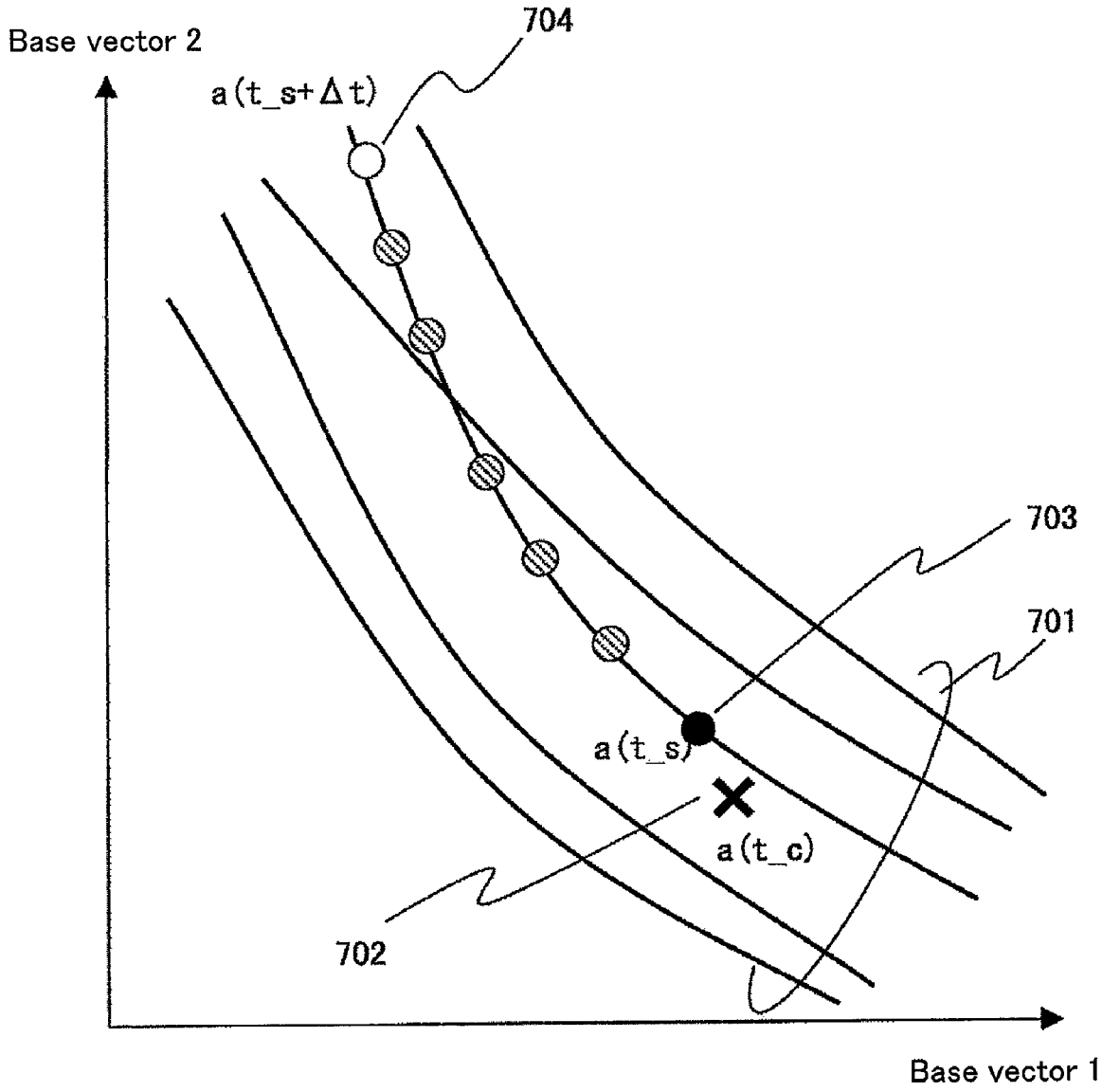
FIG. 7 is a view for explaining an example of tracing the trajectory of past projection points in the neighborhood of the current projection point to obtain the predicted projection point.

Thus, a projection point trajectory trace unit 107 traces the projection point trajectory recorded in the projection point DB 105 for a prediction target time width Δt that is the time width corresponding to a difference between the current time and the prediction target time, starting from the neighboring projection point a(t_s), and has the projection point a(t_s+Δt) as the predicted projection point of the projection point at_c+Δt). For example, supposing that the interval between the time indexes in the projection point table is 5 minutes, and the prediction target time width Δt is 30 minutes, the time index of the predicted projection time is t_(s+6) six ahead, whereby the predicted projection point is a(t_(s+6)). This is shown in FIG. 7. FIG. 7 is a partially enlarged view of FIG. 5, in which for the projection point a(t_c) 702 at the current time projected by the feature space projection unit 103, the neighboring projection point retrieval unit 106 retrieves the neighboring projection point a(t_s) 703 on the projection point trajectory 701 recorded in the projection point DB 105. And the projection point trajectory trace unit 107 traces the projection point a(t_s+Δt) 704 at the time set forward Δt from the neighboring projection point a(t_s) 703, whereby this projection point is the predicted projection point.

In an inverse projection unit 108, the predicted traffic situation vector x(t_c+Δt) is calculated by inverse projection of x(t_c+Δt)=a(t_c+Δt)'Q'. Thus, using the predicted projection point a($t_s$+Δt) of the projection point a(t_c+Δt), $$x(t_c+\Delta t)\approx a(t_s+\Delta t)'Q' \quad \text{(Formula 2)}$$

Where Q' is a transposed matrix of the base matrix Q, and the predicted traffic situation vector x(t_c+Δt) is the vector of the necessary time obtained by the linear combination of the matrix Q of the base vectors having the elements making up the predicted projection point a(t_s+Δt) as the coefficients.

Figure 11:
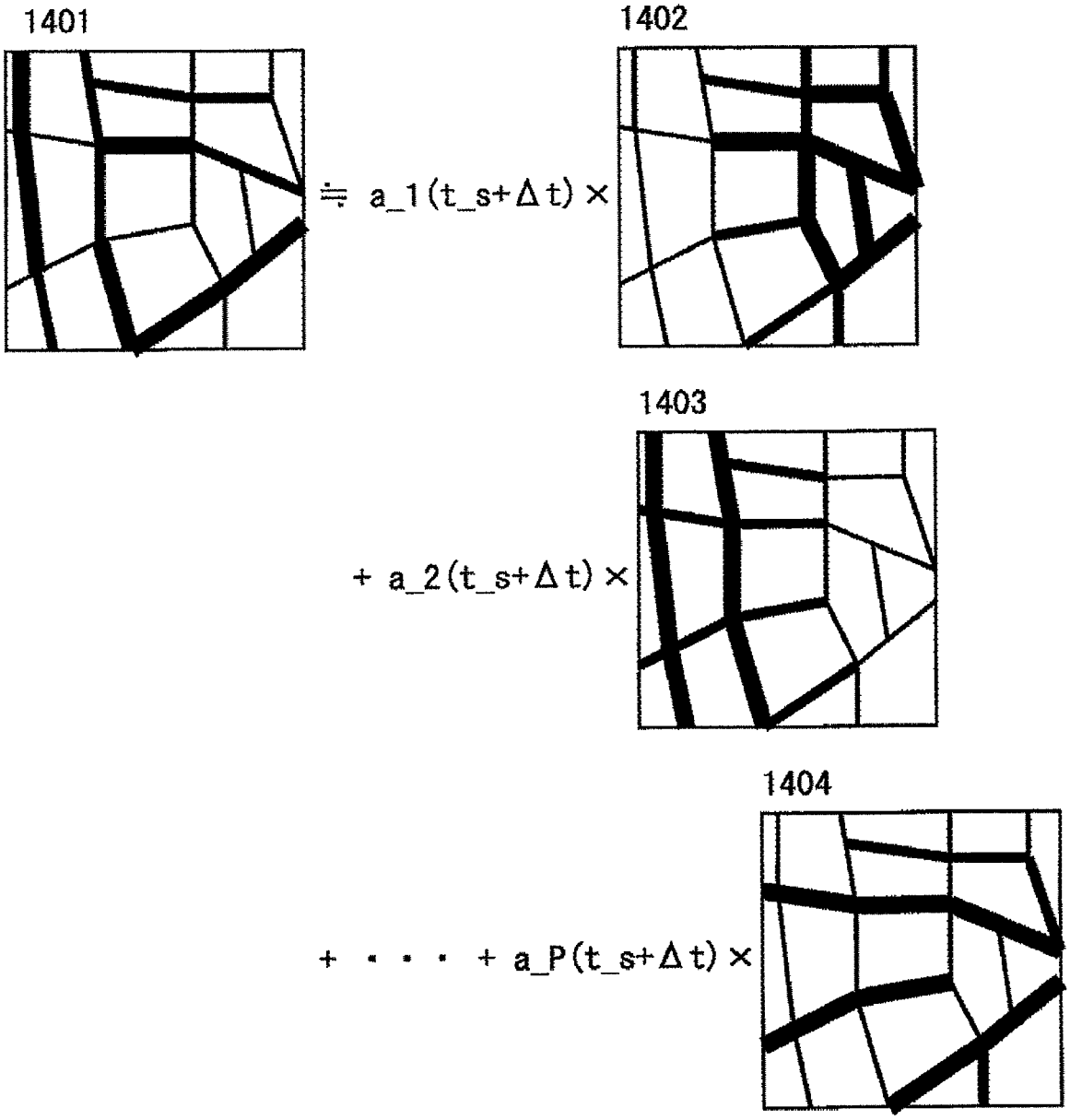
FIG. 11 is a view for explaining an example of predicting traffic information from the predicted projection points and the bases.

FIG. 11 is a typical view of a road network, like FIG. 10, showing the specific action of this arithmetic operation. Though the coefficients a_1(t_c), a_2(t_c), . . . , and a_P(t_c) of the linear combination in FIG. 10 are obtained in the formula 1, the predicted traffic situation vector (1401) is obtained in the formula 2 by making the linear combination of the base vectors (1402, 1403, 1404) having the coefficients that are the predicted values a_1(t_s+Δt), a_2(t_s+Δt), . . . , and a_P(t_s+Δt) of the coefficients a_1(t_c+Δt), a_2 (t_c+Δt), . . . , and a_P(t_c+Δt) of the linear combination in FIG. 11. Each element of the predicted traffic situation vector x(t_c+Δt) is the predicted value of the necessary time for each link in the prediction target link set. Even when the traffic situation vector x(t_c) at the current time projected by the feature space projection unit 103 contains the unknown value, the predicted traffic situation vector x(t_c+Δt) is the linear combination of the base vectors, and does not contain the unknown value, whereby the necessary time for every link in the prediction target link set can be predicted, as indicated in the formula 2.

The predicted value of the necessary time for each link obtained in the above way is converted into traffic information by the processing unit 2, and distributed from the traffic information center 204 via the communication network 203 to the vehicle.

Though in this embodiment, the necessary time table recorded in the necessary time DB 101 is not classified by the day of the week or the weather but is subjected to the principal component analysis of the base vector generation unit 102, the necessary time table may be classified by the day of the week or the weather and subjected to the principal component analysis. In this case, the generated base vectors are intrinsic to the day of the week or the weather, the process of the projection point trajectory generation unit 104 is likewise performed by making classification according to the day of the week or the weather and creating the projection point table of the projection point DB 105 for each day of the week or each weather, and the processes of the feature space projection unit 103, the neighboring projection point retrieval unit 106, the projection point trajectory trace unit 107, and the inverse projection unit 108 are performed, using properly the base vectors and the projection point table according to the day of the week or the weather on the prediction target day, whereby the traffic situation intrinsic to the day of the week or the weather can be predicted.

In this case, the traffic information prediction apparatus 1 acquires the day of week information from a calendar, not shown, and the meteorological information of the area applicable to each map mesh from the outside, and administers the necessary time DB 101, the base DB 109, the necessary time table of the projection point DB 105, the base vectors, and the projection point trajectory according to the day of the week or the weather. And the necessary time is predicted using the corresponding base vectors and projection point trajectory, based on the present day of the week or the weather.

Embodiment 2

A modified embodiment having a different way of obtaining the predicted projection point from the embodiment 1 will be described below. In the embodiment 1, since the feature point trajectory draws the periodic trajectory, the neighboring projection pint is obtained by retrieving the projection point history of the past traffic situation data in the neighborhood of the feature point corresponding to the present traffic situation from the projection point DB 105, and the predicted projection point is obtained by tracing the projection point trajectory, starting from the retrieved projection point. On the contrary, the embodiment 2 is the same as the embodiment 1, except that a plurality of predicted projection points are obtained by retrieving a plurality of neighboring projection points, without using the single neighboring projection point, but, and the necessary time is predicted based on its representative value.

Figure 8:
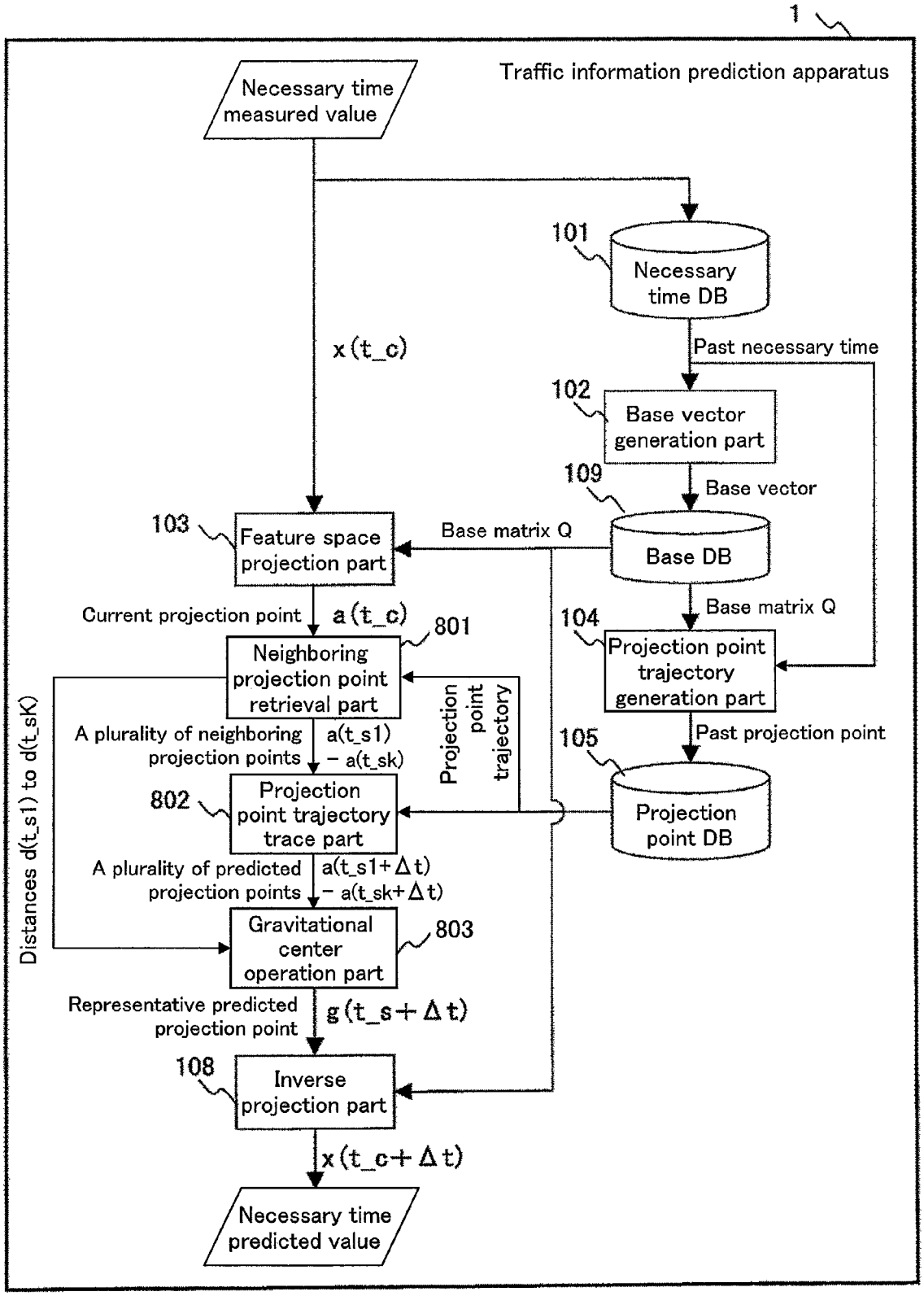
FIG. 8 is a functional diagram of a traffic situation prediction apparatus according to a modified embodiment of the invention.

Specifically, instead of the neighboring projection point retrieval unit 106 and the projection point trajectory trace unit 107 of the traffic information prediction apparatus 1 in the block diagram as shown in FIG. 1, a neighboring projection point retrieval unit 801 obtains a plurality of neighboring projection points and a projection point trajectory trace unit 802 obtains the trace result of the projection point trajectory corresponding to the plurality of neighboring projection points in the block diagram as shown in FIG. 8. And a gravitational center operation unit 803 is newly added, and the representative predicted projection point is obtained from the trace result of a plurality of projection point trajectories.

In the neighboring projection point retrieval unit 801, at step S604 in a processing flow shown in FIG. 6B, as in FIG. 6A that is the processing flow of the neighboring projection point retrieval unit 106, the K projection points having the shorter distance d(t_i) from the projection point a(t_c) at the current time are obtained as the neighboring projection points a(t_s1) to a(t_sK), and further the distance data d(t_s) to d(t_sK) corresponding to the neighboring projection points are obtained. The plurality of neighboring projection points a(t_1) to a(t_sK) obtained are sent to the projection point trajectory trace unit 802, and the distance data d(t_s) to d(t_sK) are sent to the gravitational center operation unit 803.

Herein, regarding the number K of projection points selected as the neighboring projection points, supposing that the period for accumulating the traffic situation vector in the necessary time table to obtain the projection point trajectory is about one month, and the interval of time index for data is 5 minutes, for example, it is expected that the projection point representing the traffic situation very analogous to the projection point a(t_c) corresponding to the present traffic situation in this projection point history appears at about two to three projection points a day, namely, for about 15 minutes, whereby K is 100 or less in estimating for about 30 days.

Figure 9:
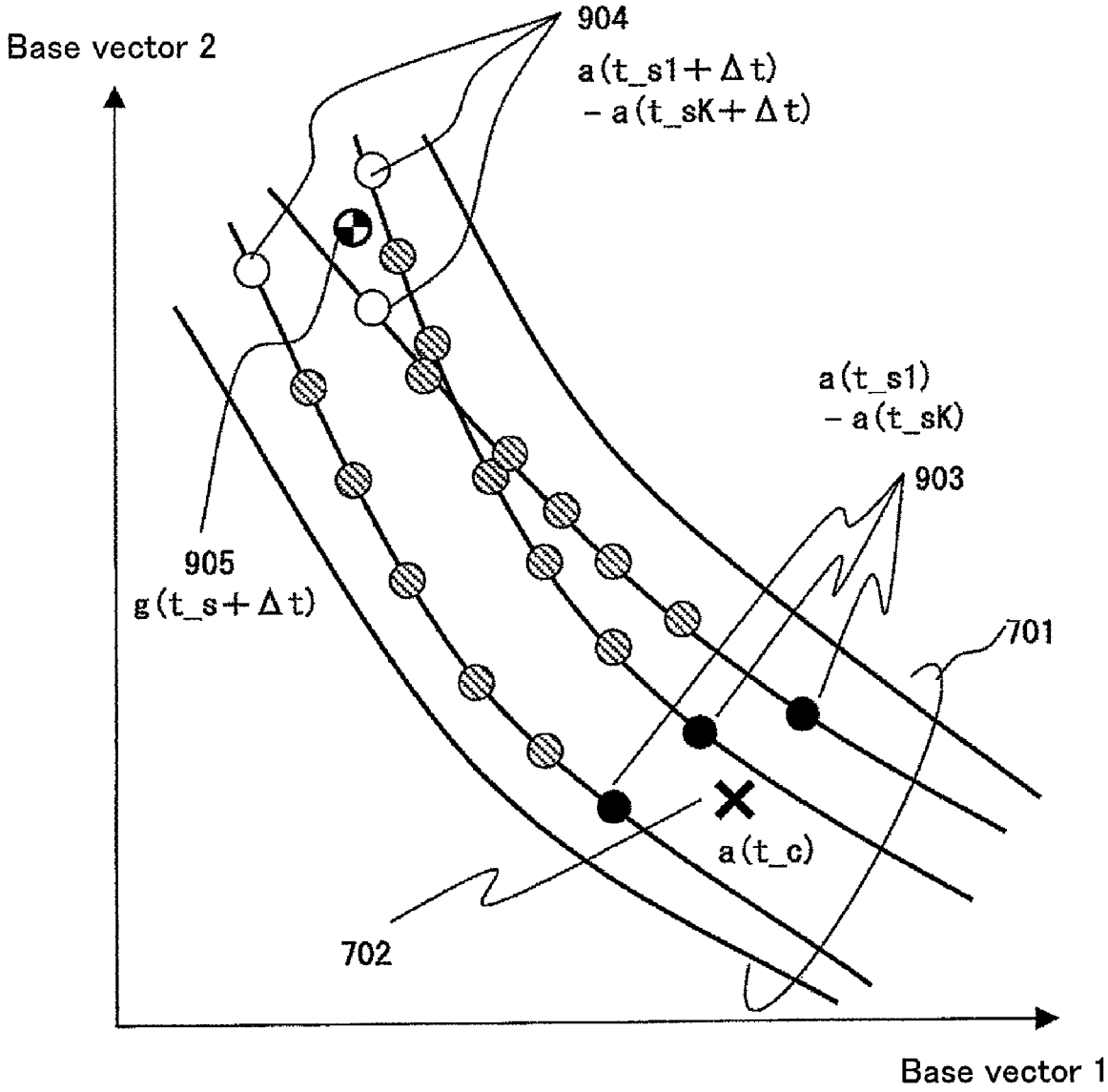
FIG. 9 is a view for explaining an example of tracing a plurality of trajectory of past projection points in the neighborhood of the current projection point to obtain the predicted projection points.

The projection point trajectory trace unit 802 traces the projection point trajectory stored in the projection point DB 105 for each of the neighboring projection points a(t_s1) to a(t_sK) retrieved by the neighboring projection point retrieval unit 801, to obtain the predicted projection points a(t_s1+Δt) to a(t_sK+Δt) from the projection point DB 105. This is illustrated in FIG. 9, like FIG. 7. Reference numeral 701 denotes the projection point trajectory recorded in the projection point DB 105, reference numeral 702 denotes the projection point corresponding to the traffic situation at the present time projected by the feature space projection unit 103, and reference numeral 903 denotes a plurality of neighboring projection points retrieved by the neighboring projection point retrieval unit 801. A representative predicted projection point 905 is obtained by the gravitational center operation unit 803, based on the predicted projection points 904 set forward Δt from the neighboring projection points.

The gravitational center operation unit 803 calculates the gravitational center for the predicted projection points a(t_s1+Δt) to a(t_sK+Δt) traced by the projection point trajectory trace unit 802 to have the representative predicted projection point g(t_s+Δt). Herein, considering that the projection point in the shorter distance from the projection point corresponding to the present traffic situation in the feature space, that is, the projection point corresponding to the state analogous to the present traffic situation is more analogous in the ensuing change, the projection point closer to the projection point a(t_c) at the present time among the neighboring projection points a(t_s1) to a(t_sK) is more strongly weighted to estimate the representative predicted projection point 905. The gravitational center operation for obtaining the representative predicted projection point 905 is performed in accordance with the following expression.

$$g(t_s+\Delta t)=\Sigma(1/d(t_si))\times a(t_si+\Delta t) \quad \text{(Formula 3)}$$

$$(i=1, 2, \ldots, K)$$

If a(t_si+Δt) and d(t_si) are inputted from the projection point trajectory trace unit 802 and the neighboring projection point retrieval unit 801, the representative predicted projection point g(t_c+Δt) is obtained as the output. Though the weighted term in inverse proportion to the distance d(t_si) is the primary term here, the weighted term in inverse proportion to the distance d(t_si) may be the secondary term to adjust the weighting as follows.

$$g(t_s+\Delta t)=\Sigma(1/d(t_si)\hat{}2)\times a(t_si+\Delta t) \quad \text{(Formula 4)}$$

The predicted value of the necessary time based on the representative predicted projection point g(t_c+Δt) obtained by tracing the projection point trajectory from the plurality of neighboring projection points is calculated from the following formula 5 by the inverse projection unit 108 in the same way as in the embodiment 1.

$$x(t_c+\Delta t)\approx g(t_s+\Delta t)'Q' \quad \text{(Formula 5)}$$

Though the number K of neighboring projection points is about 100 in the previous embodiment, it is not required that the number K is strictly determined by making much of the analogous projection point in obtaining the representative predicted projection point, because the projection point having the larger distance from the current projection point has the lower degree of contribution when the gravitational center operation unit 803 calculates the gravitational center g(t_s+Δt). Therefore, estimating that the projection point representing the traffic situation analogous to the present situation appear at about 5 or 6 projection points per day, namely, for about 30 minutes, K may be set to 150, which causes no large change in the prediction result of g(t_s+Δt), whereby it is possible to obtain the stable prediction result less dependent on the value of K.

As described above, the plurality of predicted projection points are obtained by retrieving the plurality of neighboring projection points, and the necessary time is predicted based on the representative value, whereby it is possible to suppress the influence due to a variation in the local projection point trajectory occurring depending on the presence or absence of missing data for projection and make the prediction at higher precision than the embodiment 1.

What is claimed is:

1. A traffic situation prediction apparatus for predicting a traffic situation, said apparatus having a base generation unit for generating the bases by making a principal component analysis for the necessary time of a plurality of road sections in the past, comprising:

a feature space projection unit for projecting the necessary time of the plurality of road sections at present to a feature space having said bases as the axes to obtain a current projection point;

a neighboring projection point retrieval unit for retrieving a projection point in the neighborhood of said current projection point based on a projection point trajectory that is a sequence of projection points of projecting the necessary time of said plurality of road sections in the past with said bases;

a projection point trajectory trace unit for tracing said projection point trajectory starting from the projection point in the neighborhood of said current projection point for a time width between the present time and the prediction target time to obtain the projection point; and an inverse projection unit for inversely projecting the projection point traced by said projection point trajectory trace unit to calculate the predicted value of the necessary time of said plurality of road sections.

2. The traffic situation prediction apparatus according to claim 1, further comprising a projection point trajectory generation unit for generating said projection point trajectory by projecting the necessary time of said plurality of road sections in the past.

3. The traffic situation prediction apparatus according to claim 1, further comprising a gravitational center operation unit for calculating a representative projection point by making a gravitational center operation for the plurality of projection points, wherein said neighboring projection point retrieval unit retrieves the plurality of projection points in the neighborhood of said current projection point, said projection point trajectory trace unit traces said projection point trajectory starting from the plurality of projection points retrieved by said neighboring projection point retrieval unit to obtain the plurality of projection points, said gravitational center operation unit calculates the representative projection point from said plurality of projection points, and said inverse projection unit inversely projects said representative projection point to calculate the predicted value of the necessary time of said plurality of road sections.

4. A traffic situation prediction method for predicting a traffic situation using the bases generated by a principal component analysis for the necessary time of a plurality of road sections in the past, comprising:

projecting the necessary time of said plurality of road sections at present to a feature space having said bases as the axes to obtain a current projection point;

retrieving a projection point nearest to said current projection point from a projection point trajectory that is a sequence of projection points for the necessary time of said plurality of road sections in the past to have a neighboring projection point;

tracing said projection point trajectory starting from said neighboring projection point for a time width between the present time and the prediction target time to obtain the projection point; and inversely projecting said projection point with said bases to calculate the predicted value of the necessary time of said plurality of road sections.

5. The traffic situation prediction method according to claim 4, further comprising generating said projection point trajectory by projecting the necessary time of said plurality of road sections in the past to said feature space.

6. A traffic situation prediction method for predicting a traffic situation, comprising:

generating the bases by a principal component analysis for the necessary time of a plurality of road sections in the past;

projecting the necessary time of said plurality of road sections at present to a feature space having said bases as the axes to obtain a current projection point;

retrieving a plurality of projection points in the neighborhood of said current projection point from a projection point trajectory that is a sequence of projection points of projecting the necessary time of said plurality of road sections in the past with said bases to have the neighboring projection points;

tracing said projection point trajectory starting from said neighboring projection points for a time width between the present time and the prediction target time to obtain a plurality of projection points;

defining the gravitational center of said plurality of projection points as a representative projection point; and inversely projecting the representative projection point with said bases to calculate the predicted value of the necessary time of said plurality of road sections.

* * * * *